US005910080A

United States Patent [19]

Selton

[11] Patent Number: 5,910,080

[45] Date of Patent: Jun. 8, 1999

[54] THERAPEUTIC BEDDING PAD

[76] Inventor: Daniel E. Selton, 5350 Powers Ferry Rd., Atlanta, Ga. 30327

[21] Appl. No.: 08/864,647

[22] Filed: May 28, 1997

Related U.S. Application Data

[63] Continuation-in-part of application No. 08/699,789, Aug. 19, 1996, Pat. No. 5,754,998.

[51] Int. Cl.[6] ..... A47C 21/00; A47C 27/14

[52] U.S. Cl. ..... 5/652; 5/425; 5/655.9; 5/732; 5/740

[58] Field of Search ..... 5/424, 425, 652, 5/513, 655, 655.9, 691, 732, 740

[56] References Cited

U.S. PATENT DOCUMENTS

| | | | |
|---|---|---|---|
| D. 259,458 | 6/1981 | Fuller et al. | D6/201 |
| D. 343,756 | 2/1994 | Sher | D6/601 |
| 1,777,477 | 10/1930 | Sampson | 5/655.3 |
| 3,013,281 | 12/1961 | Steiner | 5/62 |
| 3,148,387 | 9/1964 | Sarnie et al. | 5/327 |
| 3,161,436 | 12/1964 | Hood | 5/655.9 |
| 4,286,344 | 9/1981 | Ikeda | 5/424 |
| 4,332,042 | 6/1982 | Koncelik | 5/424 |
| 4,383,713 | 5/1983 | Roston | 297/219 |
| 4,397,052 | 8/1983 | Lund, III | 5/631 |
| 4,471,767 | 9/1984 | Guimond | 128/24 |
| 4,788,726 | 12/1988 | Rafalko | 5/93 |
| 4,799,273 | 1/1989 | Elze | 5/81.1 C |
| 4,862,539 | 9/1989 | Bokich | 5/740 |
| 4,872,228 | 10/1989 | Bishop | 5/425 |
| 4,873,734 | 10/1989 | Pollard | 5/425 |
| 4,967,433 | 11/1990 | Neal | 5/655.9 |
| 5,165,130 | 11/1992 | Wendling | 5/655 |
| 5,266,378 | 11/1993 | Stephenson et al. | 5/417 X |
| 5,351,348 | 10/1994 | Beger | 5/420 |
| 5,450,640 | 9/1995 | Patton et al. | 5/655 |
| 5,455,973 | 10/1995 | Brumfield et al. | 5/424 |
| 5,499,418 | 3/1996 | Tan et al. | 5/655 |
| 5,524,640 | 6/1996 | Lisak et al. | 128/846 |

FOREIGN PATENT DOCUMENTS

| | | | |
|---|---|---|---|
| 2 163 951 | 3/1986 | United Kingdom | 5/424 |

*Primary Examiner*—Michael F. Trettel
*Assistant Examiner*—Robert G. Santos
*Attorney, Agent, or Firm*—Troutman Sanders LLP; Gerald R. Boss, Esq.

[57] ABSTRACT

A therapeutic bedding pad having a body portion and two laterally spaced elongated portions. The body portion is preferably disposed to overly a bedding mattress and includes a head end and a foot end. The two elongated portions are symmetrically disposed laterally opposite the body portion and are substantially the same length as the body portion. The portions further define curved surfaces that are elevated several inches above the surface of the body portion to provide support for a user.

4 Claims, 3 Drawing Sheets

THERAPEUTIC BEDDING PAD

This application is a continuation-in-part of application Ser. No. 08/699,789 filed on Aug. 19, 1996 and now U.S. Pat. No. 5,754,998.

FIELD OF THE INVENTION

The present invention generally relates to bedding surfaces, and more particularly to an overlying pad that forms a therapeutic bedding surface.

DISCUSSION OF THE RELATED ART

Contoured bedding surfaces and bedding support devices have long been known. The most common application of such devices relates to infant bedding. Indeed, a number of devices are known to provide support for resting infants. In this regard, it is preferred to place sleeping infants on their sides for a variety of reasons, including the prevention of choking and to realize a lower incidence of sudden infant death syndrome (SIDS). As a result, padded bedding devices are known to support infants in a side-disposed position.

Also known for use with infants are bedding devices that provide side-rails or other side supports that prevent infants from rolling out of bed. Similar devices are also known for use in adult bedding. For example, U.S. Pat. 4,286,344 (the '344 patent) to Ikeda discloses a mattress having a pair of laterally-disposed padded ridges that are adapted to prevent a user lying on the mattress, from falling from the mattress. As specifically taught by the '344 patent, a varied foaming rate is utilized, so that the ridges are harder than the centrally-disposed elastomeric layer. Since this makes the mattress more rigid at its outer margins than at the central part, the ridges more effectively prevent a user from falling from the mattress.

There are, however, shortcomings manifest in the apparatus of the '344 patent. One such shortcoming relates to comfort-quality of the mattress. Specifically, the more rigid ridges are intended to motivate a user away from the edges and thus prevent the user from falling off the mattress. Consequently it does not offer therapeutic quality that enhances comfort and relaxation, and therefore promote sleep.

SUMMARY OF THE INVENTION

Accordingly, a primary object of the present invention is to provide an improved sleep surface contoured to offer enhanced therapeutic properties.

A more specific object of the present invention is to provide pad for overlying a mattress that is contoured to provide an improved sleep surface for persons with back pains.

A related object of the present invention is to provide an improved sleep surface for pregnant women.

Another object of the present invention is to provide a pad for overlying a mattress that is contoured to provide a more comfortable, sleep promoting surface.

Yet another object of the present invention is to provide an improved sleep surface that impedes the formation of bed sores on users.

Furthermore, it is an object of the present invention to provide a smaller, more portable therapeutic sleeping surface which provides support for an isolated portion of the body.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, the present invention is generally directed to a pad for a therapeutic bedding surface. In accordance with the invention the pad comprises a body portion and two laterally spaced elongated portions. The body portion is preferably disposed to overlie a bedding mattress and includes a head end and a foot end. The two elongated portions are symmetrically disposed laterally along the body portion and are substantially the same length as the body portion. The elongated portions further define a curved surface that is elevated several inches above the surface of the body portion.

In accordance with another aspect of the invention, a similar pad for a therapeutic bedding surface is directed for use with larger size mattresses, such as double, queen, and king-sized. In this embodiment, an additional, elongated central portion is disposed substantially parallel with the other two elongated portions and at the substantial midpoint therebetween. The elongated central portion has a curved surface that is elevated several inches above the surface of the body portion and defines symmetrically-disposed concave regions on either side of the elevated portion and between the elevated portion and the body portion. In this embodiment, the central portion may be simultaneously used, or otherwise shared between two users on a single mattress.

DESCRIPTION OF THE DRAWINGS

The accompanying drawings incorporated in and forming a part of the specification, illustrate several aspects of the present invention, and together with the description serve to explain the principles of the invention. In the drawings.

Figure 1:
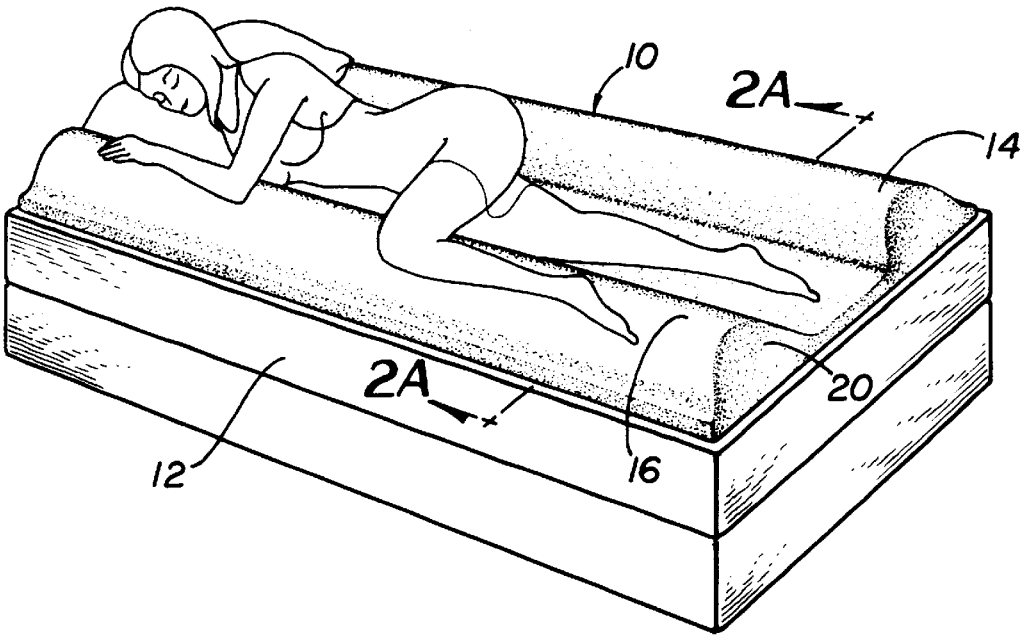
FIG. 1 is a perspective view illustrating the use of a therapeutic pad constructed in accordance with the invention and disposed in its intended environment.

Reference will now be made in detail to the description of the invention as illustrated in the drawings. While the invention will be described in connection with these drawings, there is no intent to limit it to the embodiment or embodiments disclosed therein. On the contrary, the intent is to cover all alternatives, modifications and equivalents included within the spirit and scope of the invention as defined by the appended claims.

DETAILED DESCRIPTION OF THE PREFERRED EMBODIMENT

Turning now to the drawings, FIG. 1 is a perspective view illustrating the use of a therapeutic mattress-covering pad, generally designated by reference numeral 10, constructed in accordance with the present invention. The pad 10 is preferably sized to over lie a mattress 12 in juxtaposition, and is contoured to provide therapeutic support for a person lying thereon.

More specifically, the pad 10 comprises a resilient (preferably foam) material and is shaped to provide two elongated portions or ridges 14 and 16, extending along the length of the pad 10, parallel to the sides of the pad 10. While elongated ridges 14 and 16 will be described in more detail below, briefly the ridges 14 and 16 define a curved surface that is elevated from the body of the pad 10. Unlike prior art bedding devices that are operable to prevent a user from rolling out of bed, the therapeutic pad 10 of the present invention is intended to add comfort and support a portion of the user during rest. In this regard, rather than minimizing the width of the elongated portion so as to maximize the sleeping area, the ridges 14 and 16 preferably invade the sleep area of the body portion to reduce the size of the flat or open area.

As illustrated in FIG. 1, in one form of use, the therapeutic pad 10 is intended to receive and support a portion of the user's body. For example, the user sleeping on his or her side may rest and support his upper leg on the elevated portion of ridge 16. In experiments conducted with the invention, this has been found to reduce the torque on the lower lumbar region of the spine and therefore reduce backaches, commonly incurred from sleeping. In this regard, many people have been known to use a secondary pillow, such as a body pillow, to place between their legs while sleeping to perform much the same function. Indeed, many doctors encourage pregnant women to sleep in this manner to improve circulation and reduce lower back pain. Unlike a body pillow, which must be carried with the user as the user rolls in bed, the elevated ridges 14 and 16 provide symmetrically disposed supports on either side of the user for support on either side while sleeping.

In addition to using the elevated contours 14 and 16 for frontal support as illustrated in FIG. 1, they may be used for back supports as well. In this regard, a user facing away from the nearest ridge 14 or 16 may lay with his or her back immediately adjacent, and indeed cradled by, the nearest ridge. This aspect or use of the invention recognizes the fact that, although humans have adapted to sleeping on a flat-surfaced mattress due in large part to the ease of manufacture, most animals that sleep in the wild do so in nesting fashion. That is, they use or create a contoured support or other structure to provide support and security. For example, dogs demonstrate this tendency when sleeping with humans by curling up in the cradle formed by the human's bent legs. Recognizing this innate desire or tendency among animals, the present invention may also be utilized to facilitate this "nesting" aspect by cradling and supporting a user's back.

As illustrated above, another feature of the preferred embodiment, relates to the desired length of the therapeutic pad 10. While the width of the pad is preferably substantially the same width as the underlying mattress, whether it be twin, double, queen, or king-sized, the length of the pad 10 is preferably shorter than the length of the underlying mattress 12. In one use, this allows a user to permit his feet to hang over the bottom edge 18 (See FIG. 3A) of the pad and rest directly on the mattress 12. Furthermore, the foot-end of the contoured ridges 14 and 16 are tapered at 20 to allow the user to drape or rest his foot along the tapered region 20 (See FIG. 4), if desired.

Figure 2A:
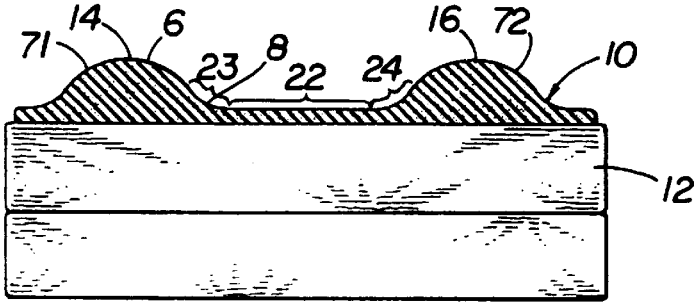
FIG. 2A is a cross-sectional view as taken substantially along line 2A—2A of FIG. 1.

Referring now to FIG. 2A, a cross-sectional view as taken substantially along lines 2A—2A of FIG. 1. This view more clearly shows a preferred shape of the contour of ridges 14 and 16. As previously mentioned, the pad 10 includes a central region or body portion 22 that is substantially flat or gently curved. In the preferred embodiment, the thickness of this body portion is approximately one inch. It has been found that such a one-inch layer of foam provides a comfortable underlying surface for the user. The elevated ridges 14 and 16, at their thickest or widest points, are preferably five inches in thickness, thereby elevating the top-most surface of the contours approximately four inches above the surface of the body portion. Importantly, particularly for the nesting feature of the present invention, concave regions 23 and 24 are defined, between the elongated ridges 14 and 16 and body portion 22. These concave regions effectively cradle a user's back to provide support and a sense of security for comfort during use.

Outwardly directed concave surfaces 71 and 72 are defined by ridges 14 and 16, in addition to the inwardly directed concave surfaces 23 and 24. As is more clearly illustrated in this embodiment, the ridges 14 and 16 preferably invade the sleep area to provide therapeutic support for a user, unlike prior art devices like that illustrated in the '344 patent, which merely provide a protective barrier for preventing a user from rolling out of bed.

Figure 2B:
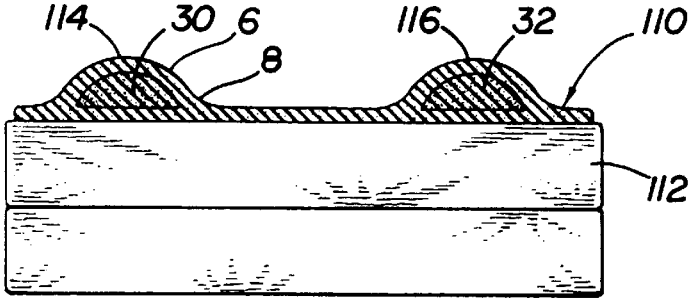
FIG. 2B is a cross-sectional view similar to that of FIG. 2A illustrating an alternative embodiment of the present invention.

FIG. 2B illustrates an alternative embodiment of the present invention. Specifically, this embodiment recognizes that a greater or lesser amount of resilience may be desired within the elongated contoured ridges of 114 and 116. In this regard, rather than provide ridges of unitary foam construction, like those of FIG. 2A, it may be desired to provide a central, elongated cavity 30 and 32 to contain an internal material of different density and/or composition. For example, in one embodiment, chopped foam, rather than a unitary foam, is used to provide softer or more resilient ridges 114 and 116.

Alternatively, a stiffer material (e.g., elongated air bags) may be utilized to provide firmer or less resilient ridges 114 and 116. A unique advantage to the use of air bags relates to the ready adjustability associated with the inflation thereof. More specifically, the inflation of air bags may be increased or decreased to provide a larger or smaller ridges 114, 116, as is suited by the particular user. Also, the degree of inflation may be varied to vary the firmness of the ridges 114, 116.

Figure 2C:
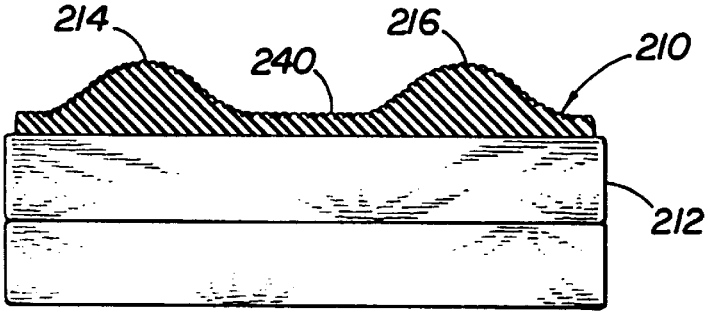
FIG. 2C is a cross-sectional view similar to that of FIG. 2A illustrating an alternative embodiment of the present invention.

FIG. 2C depicts another embodiment of the present invention. Like the embodiment of FIG. 2A, the pad 210 overlying the mattress 212 is formed of a unitary construction. However, the pad 210 has a textured or dimpled surface to provide a more therapeutic underlying construct. In one embodiment, the textured surface 240 may be comprised of egg-crate-shaped dimples or ridges. In another embodiment, the individual surface dimples may be chevron-shaped.

Figure 3A:
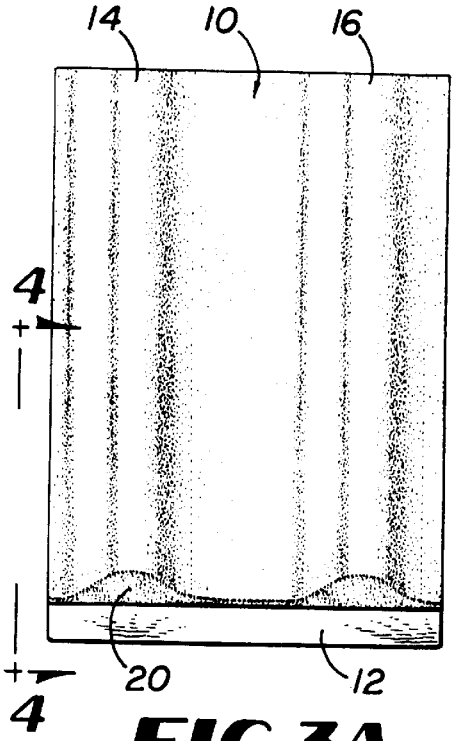
FIG. 3A is a top view of a therapeutic pad constructed in accordance with the preferred teachings of the present invention.
Figure 4:
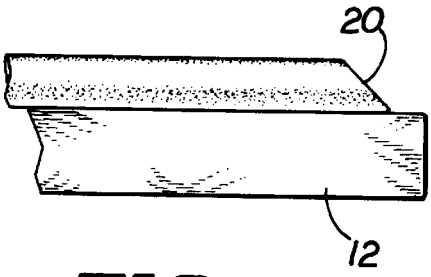
FIG. 4 is a partial side view of the foot end of the present invention as taken substantially along line 4—4 of FIG. 3A.

Referring now to FIG. 3A, a top view of the preferred embodiment of the present invention is shown. This view illustrates that the ridges 14 and 16 preferably extend the entire length of pad 10. Furthermore, the length of pad 10 is slightly shorter than the length of mattress 12, allowing the user to hang or dangle his feet over the edge 18 of pad 10, as previously described.

Figure 3B:
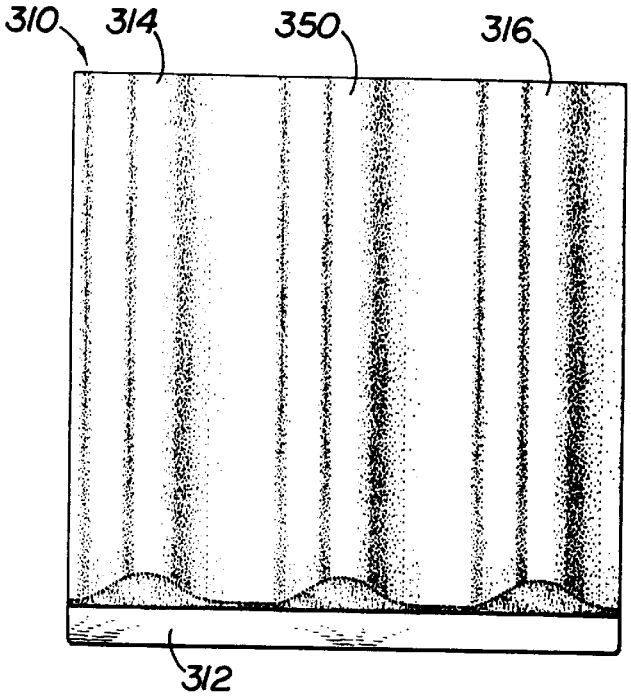
FIG. 3B is a top view of a therapeutic pad constructed in accordance with an alternative embodiment of the present invention.

FIG. 3B illustrates a further embodiment of the present invention. Indeed, the embodiment depicted in FIG. 3B is preferably used on a double, queen or king-sized bed. In use, the embodiment of FIG. 3B would allow two persons to rest on the pad 310. In short, the pad 310 is much like that illustrated in FIG. 3A, except the width mentioned would be greater, and a centrally-disposed elongated ridge 350 is provided. The elevated ridge 350 is preferably similar in elevation and construction to ridges 314 and 316. It is, however, slightly wider to facilitate the use from persons lying on both sides of the centrally disposed ridge 350.

Figure 5A:
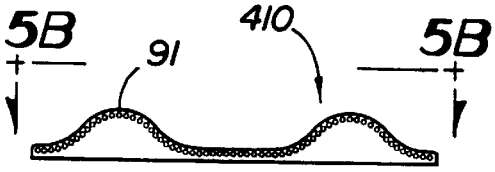
FIG. 5A is a partial cross-sectional view similar to that of FIG. 2A, illustrating yet another embodiment of the present invention.
Figure 5B:
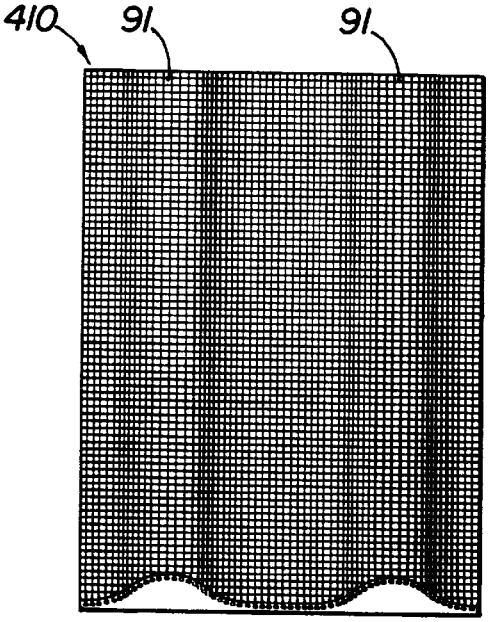
FIG. 5B is a top view of the embodiment illustrated in FIG. 5A.

Finally, FIGS. 5A and 5B illustrate yet another embodiment of the present invention. This embodiment utilizes a foam surface that has been found to further enhance the resting comfort. Specifically, the surface of the foam pad is rectangularly divided by slits 91, which permit the foam surface to better conform to the contour of the user's body.

Figure 6:
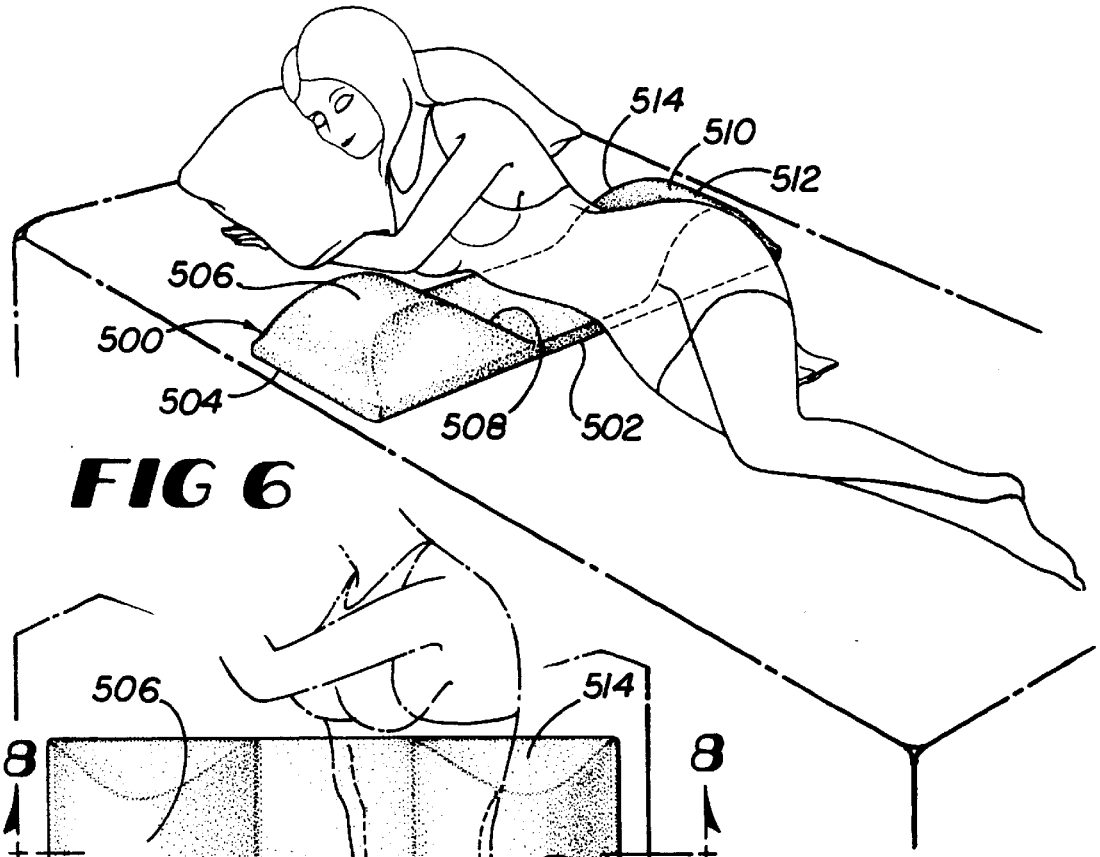
FIG. 6 is a perspective view of another embodiment illustrating the use of a therapeutic pad supporting an isolated area according to the invention.

As shown in FIG. 6, a small portable therapeutic bedding pad 500 is shown. Portable therapeutic bedding surface 500 provides support to a person resting in a horizontal position at a specific isolated area as decided by a person. As shown in FIG. 6, a person may locate the therapeutic bedding surface 500 at the lower back lumbar area for support but as it may be understood, the location of the therapeutic bedding surface 500 may be located at any desired isolated area by the person such as the upper back or at the hips.

Therapeutic bedding surface 500 includes body portion 502 which provides a comfortable resting area for a person. The first elongated portion 504 is carried on a first side of body portion 502. The first elongated portion 504 includes a top surface 506 elevated above body portion 502 which also includes a first contoured side surface 508 which gradually rises from body portion 502 to top surface 506. Disposed opposite first elongated portion 504 and carried on a second side of body portion 502 is a second elongated portion 510. The second elongated portion 510 includes top surface 512 just elevated above body portion 502 and also includes second contoured side surface 514 which gradually rises from body portion 502 to top surface 512.

Figure 7:
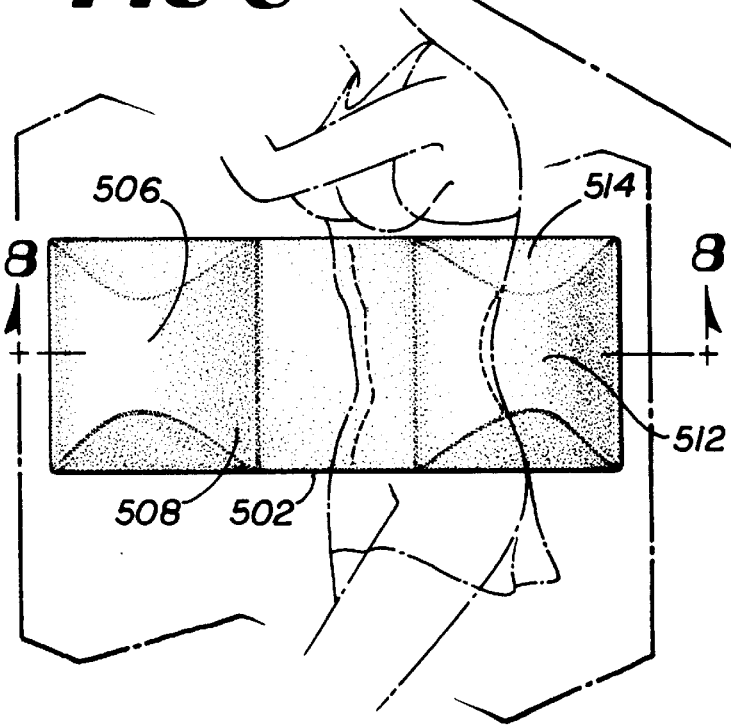
FIG. 7 is a top view illustrating the use of a therapeutic pad supporting an isolated area according to the invention.

As shown in FIG. 7, body portion 502 and first elongated portion 504 and the second elongated portion 510 are of a predetermined length less than the length of a person for supporting an isolated area 516 of a person. To support isolated area 516, first contoured side surface 508 and second contoured side surface 514 are of a general angle arising from body portion 502 to top surface 506 and 512 respectively. Thus, a person lying on a side may have an isolated area of the back side supported at an angle while the remainder of the person is generally horizontal. In the preferred embodiment this angle is forty-five degrees. A result from this angle is that a person's weight may be positioned on a contoured surface such that the elongated side pivots toward the body with the transition portions 520 and 522 acting as fulcrums.

Figure 8:
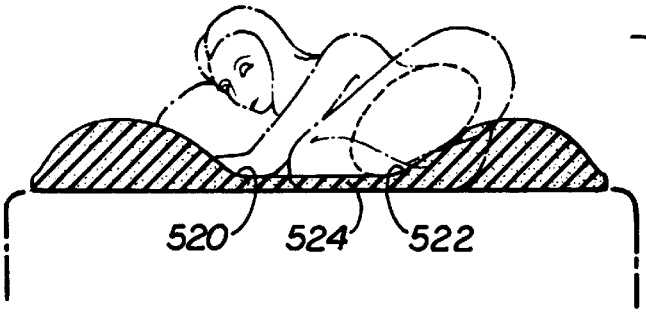
FIG. 8 is a cross-sectional view taken along line 8—8 of FIG. 7.

As shown in FIG. 8, the second contoured side surface 514 is contoured to matingly adapt to isolated area 516 of a person. Thus, as shown in FIG. 8, a person may support an isolated area such as a lower back while the remainder of the body is free to lay horizontal. First contoured side surface 508 is also contoured to matingly adapt to an isolated area thus providing a person with the option of lying on either side.

Figure 9:
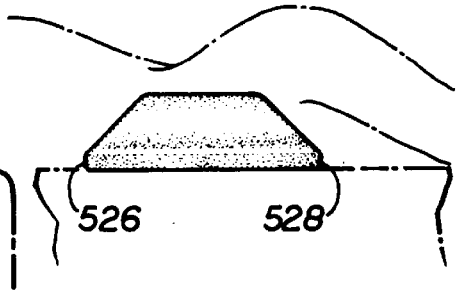
FIG. 9 is a side view of a therapeutic pad constructed in accordance with an alternative embodiment of the present invention.

As shown in FIGS. 8 and 9, the first and second contoured side surfaces 508 and 514 are of general concave profile for conforming to the contour of a person's backside for supporting a person's backside when a person is lying generally horizontally on body portion 502. By being contoured in a general concave manner, the first and second contoured surfaces 508 and 514 may support the backside of the person while also providing a gradual support at concave position points 520 and 522 which supports the transitional area of the body from a general angled position to a horizontal position while lying on a mattress.

As shown in FIG. 8, the combination of first and second elongated portions 504 and 510 along with the transition portions 520 and 522, provide an encircling resting area which encloses resting area 524. Resting area 524 psychologically provides comfort to a person since gradual transitions exist between first elongated portion 504 and the second elongated portion 510, thus defining a nest.

As shown in FIG. 9, the first elongated portion 504 includes a first tapered end 526 and the second tapered end 528 which also assists in supporting an isolated area of the person.

As shown in FIGS. 6 through 9, therapeutic bedding surface 500 is of a predetermined length for supporting a general portion of a person's backside and while permitting the remaining portion of a person to extend beyond the body portion for resting on a mattress. The length of therapeutic bedding surface 500 is generally less than 20 inches and is preferably either 12 inches, 14 inches or 16 inches depending on the size of the individual utilizing the therapeutic bedding surface. Also, the overall width of the therapeutic bedding surface is such that the person may be enclosed within the profile of therapeutic bedding surface 500 and in the preferred embodiment the width of therapeutic bedding surface 500 is approximately 34 inches.

The foregoing description has been presented for purposes of illustration and description. It is not intended to be exhaustive or to limit the invention to the precise forms disclosed. Obvious modifications or variations are possible in light of the above teachings. The embodiment or embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

What is claimed is:

1. A therapeutic bedding surface for supporting a person when lying comprising:

a substantially longitudinally disposed body portion;

raised elongated portions disposed laterally along opposite sides of said body portion, said elongated portions being constructed to be elevated above the surface of the body portion and said elongated portions further including inwardly directed concave surfaces rising from said body portion having a sufficient height to receive a portion of the person's body;

said concave surfaces having a similar profile with respect to a central longitudinal axis along a predetermined longitudinal length of said elongated portions; and said concave surfaces constructed to provide positive pressure support to the body portion received body said concave surface;

wherein a person may be supported in a like manner when being supported by a first concave surface when lying on one's side of the body and when being support by a second concave surface when lying on a different side of the body.

2. The pad as defined in claim 1 wherein the elongated portions further include an elongated interior region carrying an inflatable chamber.

3. The pad as defined in claim 2 wherein the inflation of the inflatable chamber may be increased or decreased to controllably vary the size of the elongated portions.

4. The pad of claim 1 wherein said elongated portions include a top internal portion and a bottom internal portion, said bottom internal portion being inverted with respect to said top internal portion to define said concave surface for receiving and supporting a person.

* * * * *